United States Patent [19]

Biancalani

[11] Patent Number: 4,939,857

[45] Date of Patent: Jul. 10, 1990

[54] IRON WITH A MAIN ASSEMBLY BODY AND A HEAT SEPARATOR

[76] Inventor: Mauro Biancalani, Via Ida Baccini No.11, 50100 Firenze, Italy

[21] Appl. No.: 288,283

[22] Filed: Dec. 21, 1988

[30] Foreign Application Priority Data

Dec. 23, 1987 [IT] Italy ..... 9583 A/87

[51] Int. Cl.[5] ..... D06F 75/20; D06F 75/36

[52] U.S. Cl. ..... 38/77.8; 38/77.83; 38/89; 38/90

[58] Field of Search ..... 38/77.8, 89, 90, 88, 38/77.83

[56] References Cited

U.S. PATENT DOCUMENTS 4,196,340 4/1980 Evans, Jr. et al. ..... 38/77.8

4,748,755 6/1988 Bain, Jr. et al. ..... 38/90 X

FOREIGN PATENT DOCUMENTS 2650837 11/1977 Fed. Rep. of Germany ..... 38/77.8

*Primary Examiner*—Andrew M. Falik

*Attorney, Agent, or Firm*—McGlew & Tuttle

[57] ABSTRACT

An iron assembly including a handle and an incorporated reservoir both formed of a single molded piece defining a reservoir cavity having a rear opening. An obdurator is provided fixable to the molded piece to seal the reservoir cavity rear opening. The single molded piece is formed with the handle portion to define an additional cavity with an opening at the rear. The single molded piece includes a front funnel-shaped opening which communicates with the reservoir cavity at a top portion of the reservoir cavity. The single molded piece includes a bottom opening communicating with the reservoir cavity. A cover is provided engageable with the single molded piece to close the bottom opening to define a fluid delivery opening. A heating plate is provided having a fluid chamber communicating with the fluid delivery opening. A heat dissipator is disposed between the reservoir cavity and the heating plate. Molded pieces are provided defining pumping seats positioned at a top side of the single molded piece opposite the bottom opening. A pumping arrangement is provided in the pumping seats for pumping fluids in the reservoir cavity.

7 Claims, 4 Drawing Sheets

IRON WITH A MAIN ASSEMBLY BODY AND A HEAT SEPARATOR

FIELD OF THE INVENTION

The invention relates to an improved iron which includes a bottom plate which forms part of the iron which forms part of the iron and to which a limited amount of water must be supplied over a period of time. A vaporization chamber is also provided connecting the various elements of the arrangement.

BACKGROUND OF THE INVENTION

In the past, various steam iron arrangements have been provided with a steam generating feature in which steam is fed to a base plate for moistening clothes to be ironed. U.S. Pat. No. 4,196,340 issued to Evans Jr. et al teaches a plastic electrolytic steam iron which includes a plate with steam distributing means and a casing or housing of electrically non-conducting material which forms the walls of an internal water tank positioned over the base plate. Although the Evans arrangement includes relatively few parts, the arrangement still requires several parts for forming the vaporization water tank.

U.S. Pat. No. 4,748,755 to Bain Jr. et al teaches a light-weight steam pressing iron which is also made, to a great extent, of plastic. Although a great deal of the main housing is formed of a single structure, the arrangement requires several different components to form various elements including several units to form the U-shaped reservoir 58. (German application No. 265 0837 teaches an arrangement which employs a housing with various housing parts defining the necessary valve seats and valve actuators.)

SUMMARY AND OBJECTS OF THE INVENTION

It is an object of the invention to provide an iron having few parts including a single molded piece defining fluid reservoirs and cavities for various elements of the iron construction.

It is still another object of the invention to provide an iron assembly including a single molded piece defining a reservoir cavity with a bottom opening with the bottom opening sealed by a cover which may form the part of a heat separator, the cover having a fluid delivery opening, the fluid delivery opening communicating with a heating plate.

According to the invention, an iron assembly is provided with a handle and an incorporated reservoir. A single molded piece is provided which defines a reservoir cavity having a rear opening. An obdurator is fixable to the molded piece to seal the rear opening. The single molded piece provides a handle portion which defines an additional cavity which also has an opening at the rear. The single molded piece defines a front funnel-shaped opening which communicates with the reservoir cavity at a top portion of the reservoir cavity. The single molded piece defines a bottom opening which communicates with the reservoir cavity. A cover is engageable with the single molded piece to close the bottom opening, the cover defining a fluid delivery opening. A heating plate is provided with a fluid chamber communicating with the fluid delivery opening. A heat separator is positioned between the reservoir cavity and the heating plate. A single molded piece also defines pumping seats positioned at a top side of the single molded piece opposite the opening. Pumping means is provided positioned in the pumping seats for pumping fluid in the reservoir cavity.

The funnel-shaped opening is advantageously oriented upward and toward the inside of the cavity. The front funnel-shaped opening can also split into two on the inner side, so as to avoid interference with the seats of the pumping means.

A seat for a liquid projection nozzle may also be formed alongside and parallel to the front opening.

The bottom of the reservoir cavity is advantageously formed of a surface with two sections inclined upward and outward from a central line. This is provided for dissipating the heat from the interspace defined by the heat separator.

The heat separator may also be in the form of a surface with two sloping sections oriented upward and outward from a longitudinal middle zone. These are formed approximately parallel to the sections of the bottom of the reservoir cavity, or they may be in the form of a flat surface.

Still another object of the invention is to provide an iron which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
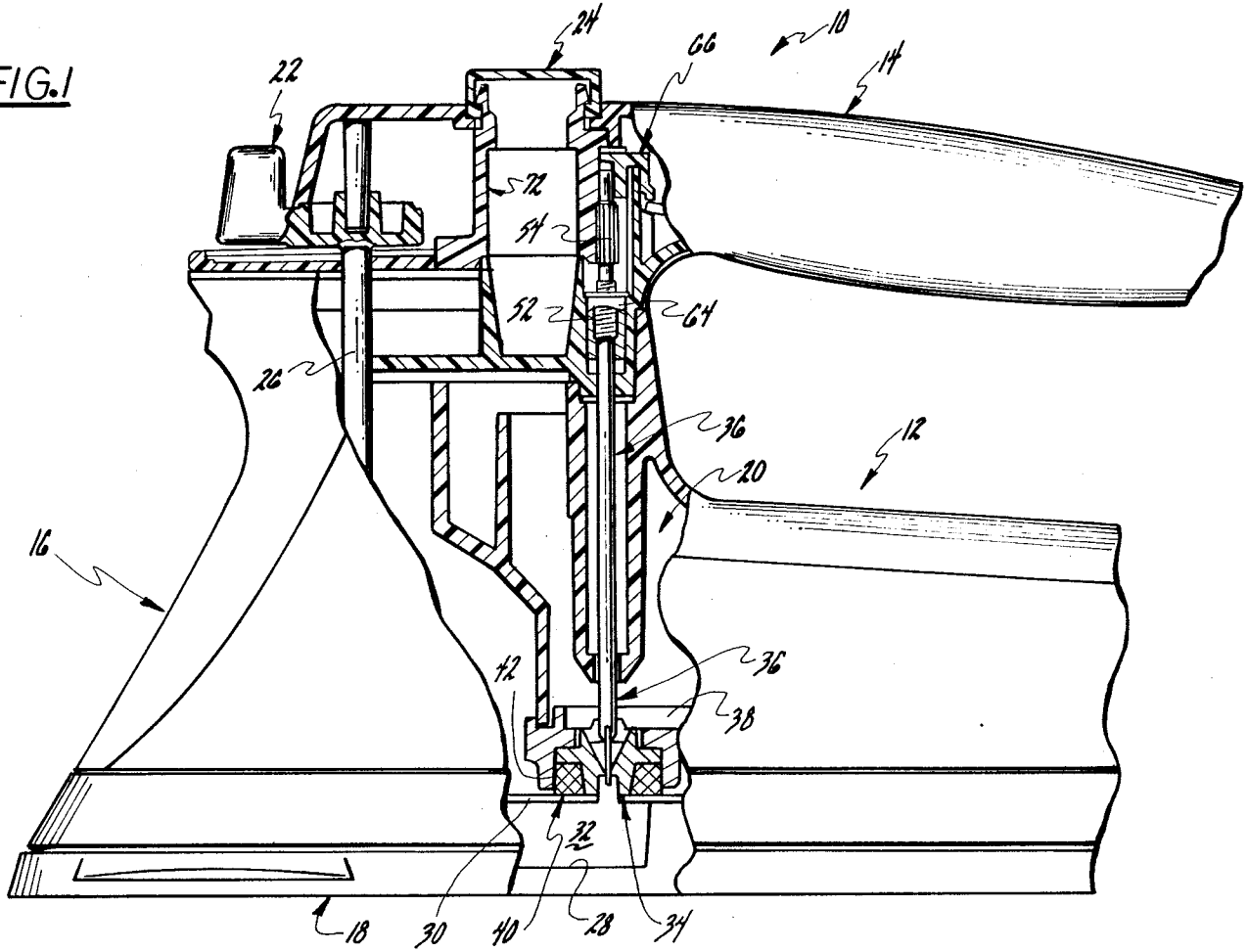
FIG. 1 is a longitudinal cross-sectional view providing an overall view of the iron according to the invention.

Referring to the drawings, in particular, the invention embodied therein includes an iron assembly with a handle and a reservoir. A bottom plate 1 is provided which forms part of the iron and to which a limited amount of water must be supplied over a period of time. The cavities 5A and 5B with rear openings are best seen from FIGS. 2 and 6 which show the handle portion defining the additional cavity 5B. The water supplies is vaporized inside a chamber 1A, in order to moisten the clothes to be ironed, on which the iron is placed. A laminar piece or heat separator 3 is positioned between the plate 1 and a main assembly body 5 of the iron. The laminar piece 3 has a cover part 3A which closes off a bottom orifice in the body 5 and forms a heat separator.

The body 5 (shown separately in FIGS. 2 and 6) is made as a single piece injection-molded unit using a mold consisting of two main parts. One of the parts is hollow and the other part is a male type part so as to form the two cavities 5A and 5B which open out at the rear (inside the body 5 assembled in the iron). By means of a suitable pin or guide in the mold, a part 5C is formed extending through the bottom of the cavity 5A, the part 5C opening out toward the bottom (when the piece is assembled) so as form an orifice 7 closed off by the cover part 3A of the separator 3, providing a suitable seal. Two seats 5E, 5F for two push button pumps are formed using another guide or pin. Still another inclined guide or pin is used to form a funnel-like passage 5H which opens out at the front and extends at an angle upward and toward the inside of the part 5C adjacent to the cavity 5A. The funnel-like passage 5H splits into two parts on the inner side sq as to form a space for the internal end connections of the two seats 5E, 5F for the pumps. This feature is shown best in the depiction of the split parts of passage 5H in dotted line in FIGS. 3 and 7. A further seat 5L for a nozzle is formed using the same pin or guide used for forming the passage 5H. The cavity 5B is shaped like a handle and defined not only by the two main male and female parts of the mold of the piece 5, but also by a transverse pin which forms the transverse opening 9 of the handle.

The piece 5 contains recesses for mounting everything which is required to form the iron. In particular, a cover or obdurator 10 sealably fixed on the rear opening of the cavity 5A is used to form the water reservoir which can be supplied by the passages 5H and is sealed by the cover 3A. The cover 3A has, inside it, a seat for a piece 12 intended to form the delivery nozzle for the vaporization water. The vaporization water can be controlled by a needle 14, so as to supply the water for vaporization in chamber 1A, the vaporization chamber being provided with steam-escape bores in the plate 1. Two pumps, indicated by 16 and 18, are accommodated in the seats 5E, 5F and are used, in a conventional manner to produce moistening jets at the front of the iron through a nozzle 20 accommodated in the seat 5L and so as to increase, in each case, the formation of steam.

The bottom 5X is formed by two symmetrical parts which are inclined upward and laterally so as to facilitate dissipation of the heat. In the embodiment shown in FIGS. 1 to 4, the two parts of the bottom 5X of the body 5 are completed by a skirting 5Z with vents 5K. The separator 3 is flat. In the variation shown in FIGS. 5 to 8, the bottom 5X of the said body 5 is further shaped by the two sections inclined upward and toward the sides from the central and longitudinal zone. In this variation, the separator 3 also consists of two sections 3X parallel with those 5X and ending in a trimming 3Y.

Figure 4:
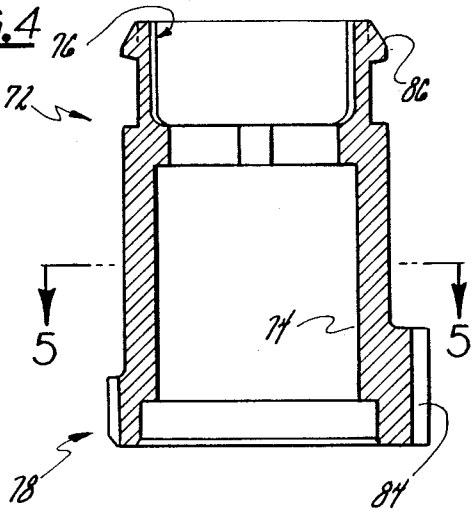
FIG. 4 is a partial cross-sectional view of the iron showing the heating plate in phantom.
Figure 6:
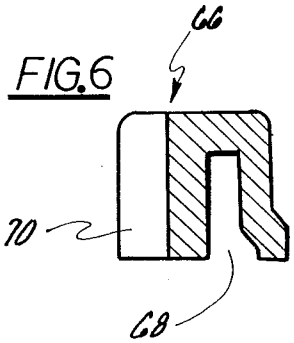
FIG. 6 is a cross-sectional view of the single molded piece which forms the body of the iron of FIG. 5.
Figure 5:
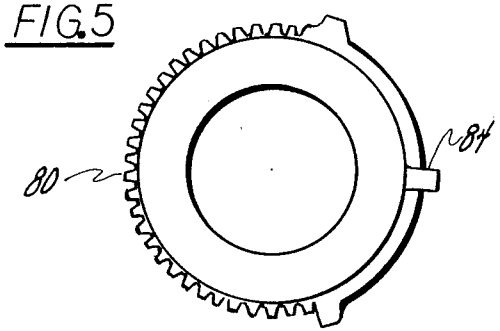
FIG. 5 is a longitudinal cross-sectional view showing an overall view of the iron according to a second embodiment of the invention.
Figure 7:
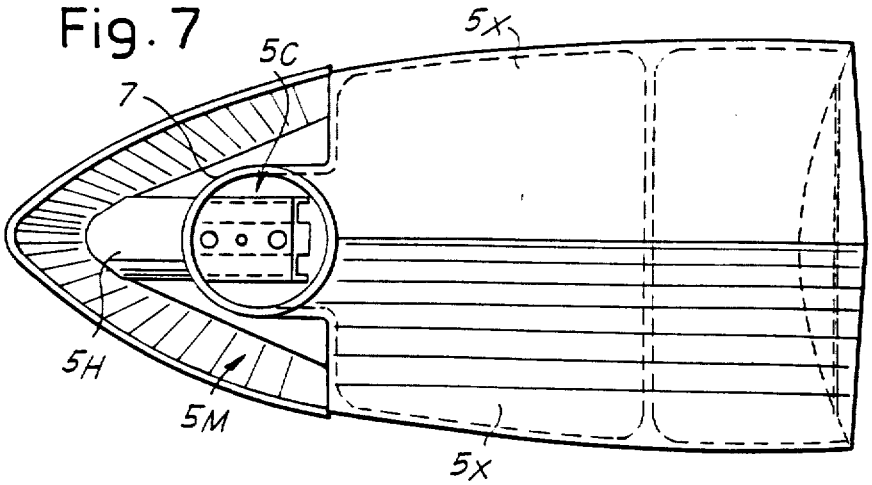
FIG. 7 is a view taken in the direction of line VII—VII of FIG. 6.
Figure 6:
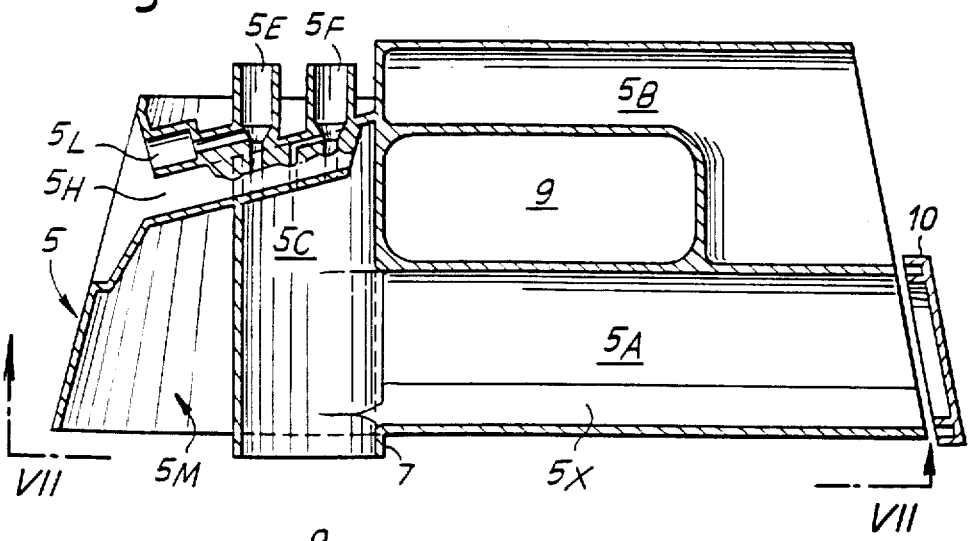
Figure 8:
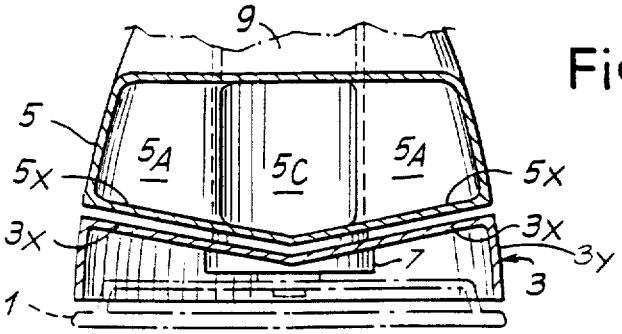
FIG. 8 is a partial cross-sectional view of the iron of FIG. 6 with the heating plate shown in phantom.

Referring to FIGS. 5 through 8 in particular, the embodiment shown in FIG. 5 is quite similar to the embodiment of FIG. 1. As can best be seen in FIG. 8, the one piece construction of the body 5 including skirting 5Z with vents 5K is replaced in the second embodiment with a body 5 without the skirting 5Z. The separator 3 includes sections 3X with a contour cooperating with bottom 5X of body 5 and also trimming 3Y (see FIG. 8). FIG. 6 shows the body 5 without the separator 3. The similarities between the body structure 5 of FIG. 2 and the body structure of FIG. 6 are evident as the differences are limited to the modifications of the body 5 and the separator 3. In each embodiment, the separator 3 limits heat transfer from the heating plate 1 to the body 5 by its interposition between the heating plate 1 and the body 5. Additionally, an interspace is provided between the separator 3 and the body 5. This interspace may be seen in FIGS. 1 and 5 between the top surface of the separator 3 and the lower surface 5X of the body 5. This space may also be seen in FIGS. 4 and 5. In FIG. 4 the interspace is provided between the separator 3 and the bottom 5X and vents are provided for dissipation of heat. In the embodiment of FIGS. 5 through 8, as best seen in FIG. 8, the interspace is formed by sections 3X and 5X which are substantially parallel, thereby defining a passage for heat dissipation. In each of the embodiments, the bottom 5X is provided by two inclined surfaces which join at a body center line or central axis which passes through the center of the body with respect to the lateral sides or with respect to the skirting 5Z (see FIG. 4). In the embodiment of FIGS. 5 through 8, the bottom 5X is disposed as in the embodiment of FIGS. 1 through 4 and includes inclined surfaces joined at a center location or along a center line with respect to the lateral sides. Sections 3X are also formed of inclined surfaces with join in the center of the arrangement.

A thermostat 22 is associated with the heating plate or vaporization plate 1, 1A and controlled by a front external operating knob 24. The thermostat and its knob are housed in the open front part 5M formed in the piece 5 using the same pin used to form the cavity 5C.

The cavity 5 houses electrical supply components and in particular the terminal 26 of the connector for the electrical cable as well as the cable tube 28. 30 denotes a rear trimming.

Using the embodiment described, the iron can be very easily assembled, the piece 5 being equipped with all the necessary features and seats for receiving the various components, which are mounted with extreme ease. Assembly of the various components (pushbutton pumps, tubes for the same, nozzle supply connection piece, delivery nozzle, thermostat and its control device, electrical terminal, etc.) is particularly easy and fast and can also be performed at least partly automatically.

It is understood that the drawings show only given examples by way of a practical demonstration of the invention, whereby the embodiments and arrangements of the invention may vary without going outside the inventive idea of the invention itself.

While specific embodiments of the invention have been shown and described in detail to illustrate the application of the principles of the invention, it will be understood that the invention may be embodied otherwise without departing from such principles.

I claim:

1. An iron assembly including a handle and an incorporated reservoir, comprising:

a single molded piece defining a reservoir cavity having a rear opening;

an obdurator fixable to said molded piece to seal said rear opening;

said single molded piece providing a handle portion defining an additional cavity with an opening at the rear;

said single molded piece defining a front funnel-shaped opening, said funnel-shaped opening communicating with said reservoir cavity at a top portion of said reservoir cavity;

said single molded piece defining a bottom opening communicating with said reservoir cavity;

a cover engageable with said single molded piece to close said bottom opening, said cover defining a fluid delivery opening;

a heating plate having a fluid chamber communicating with said fluid delivery opening;

a heat separator positioned between said reservoir cavity and said heating plate;

said molded piece defining pumping seats positioned at a top side of said single molded piece opposite said bottom opening; and pumping means positioned in said pumping seats for pumping fluid in said reservoir cavity.

2. An iron according to claim 1, wherein said funnel-shaped opening is oriented upward and directed toward an interior portion of said reservoir cavity.

3. An iron according to claim 1, wherein said funnel-shaped opening slits into two parts on an inner side of said single molded piece, thereby avoiding interference with said pumping seats and said pumping means.

4. An iron according to claim 1, wherein a nozzle seat is defined by said single molded piece formed alongside and parallel to said funnel-shaped opening, a liquid projection nozzle being positioned in said nozzle seat.

5. An iron according to claim 1, wherein said single molded piece defines a bottom of said reservoir cavity having a surface with two sections inclined upwardly and outwardly from a central line defined between lateral sides of said single molded piece, said sections dissipating heat from an interspace defined between said heat separator and said surface with two sections.

6. An iron according to claim 5, wherein said heat separator includes a surface with two sloping sections oriented upwardly and outwardly from a longitudinal middle defined below said central line between lateral sides of said single molded pieces, said sections being approximately parallel to said sections of said bottom of said reservoir cavity.

7. An iron according to claim 5, wherein said heat separator is provided with a flat surface.

* * * * *

UNITED STATES PATENT AND TRADEMARK OFFICE

CERTIFICATE OF CORRECTION

PATENT NO. : 4,939,857

DATED : July 10, 1993

INVENTOR(S) : Mauro Biancaiani

It is certified that error appears in the above-indentified patent and that said Letters Patent is hereby corrected as shown below:

The title page should be deleted to appear as per attached title page.

The sheets of drawings, consisting of figures 1-8, should be deleted to be replaced with the attached sheets, consisting of figures 1-8.

Signed and Sealed this

Seventh Day of September, 1993

Bruce Lehman

*Attest:*

BRUCE LEHMAN

*Attesting Officer*

*Commissioner of Patents and Trademarks*

United States Patent [19]

Biancalani

[11] Patent Number: 4,939,857

[45] Date of Patent: Jul. 10, 1990

[54] IRON WITH A MAIN ASSEMBLY BODY AND A HEAT SEPARATOR

[76] Inventor: Mauro Biancalani, Via Ida Baccini No.11, 50100 Firenze, Italy

[21] Appl. No.: 288,283

[22] Filed: Dec. 21, 1988

[30] Foreign Application Priority Data

Dec. 23, 1987 [IT] Italy ..... 9583 A/87

[51] Int. Cl.[5] ..... D06F 75/20; D06F 75/36

[52] U.S. Cl. ..... 38/77.8; 38/77.83; 38/89; 38/90

[58] Field of Search ..... 38/77.8, 89, 90, 88, 38/77.83

[56] References Cited

U.S. PATENT DOCUMENTS 4,196,340 4/1980 Evans, Jr. et al. ..... 38/77.8
4,748,755 6/1988 Bain, Jr. et al. ..... 38/90 X

FOREIGN PATENT DOCUMENTS 2650837 11/1977 Fed. Rep. of Germany ..... 38/77.8

*Primary Examiner*—Andrew M. Falik
*Attorney, Agent, or Firm*—McGlew & Tuttle

[57] ABSTRACT

An iron assembly including a handle and an incorporated reservoir both formed of a single molded piece defining a reservoir cavity having a rear opening. An obdurator is provided fixable to the molded piece to seal the reservoir cavity rear opening. The single molded piece is formed with the handle portion to define an additional cavity with an opening at the rear. The single molded piece includes a front funnel-shaped opening which communicates with the reservoir cavity at a top portion of the reservoir cavity. The single molded piece includes a bottom opening communicating with the reservoir cavity. A cover is provided engageable with the single molded piece to close the bottom opening to define a fluid delivery opening. A heating plate is provided having a fluid chamber communicating with the fluid delivery opening. A heat dissipator is disposed between the reservoir cavity and the heating plate. Molded pieces are provided defining pumping seats positioned at a top side of the single molded piece opposite the bottom opening. A pumping arrangement is provided in the pumping seats for pumping fluids in the reservoir cavity.

7 Claims, 4 Drawing Sheets

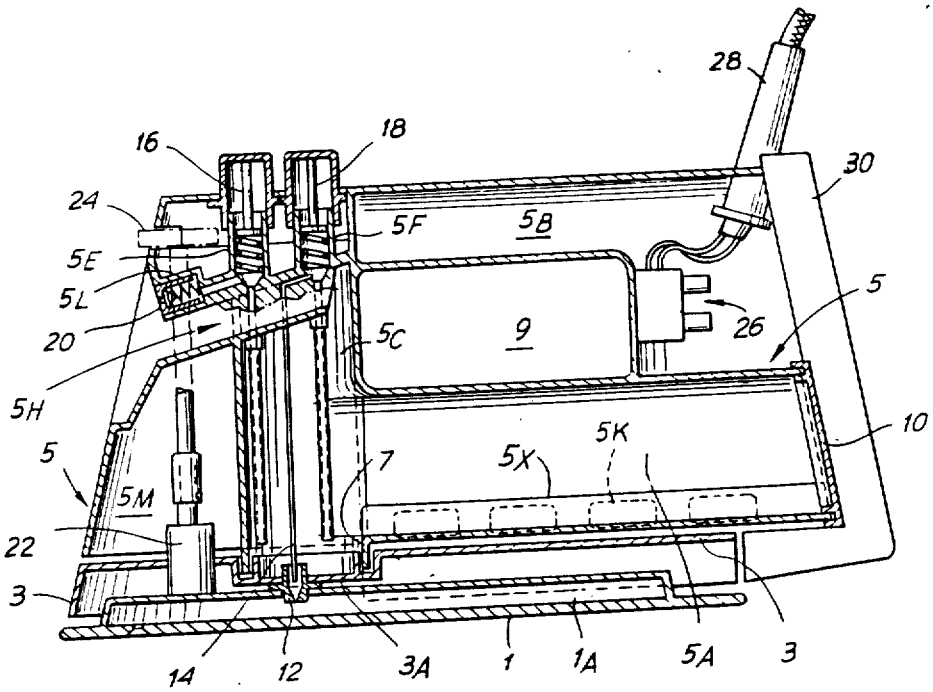

Figure 3:
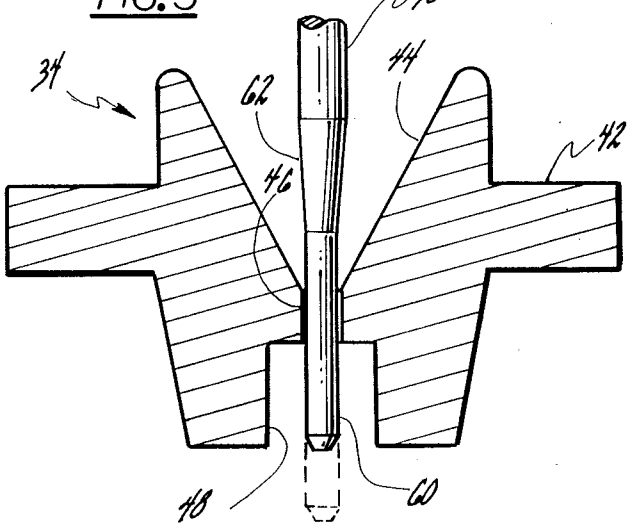
FIG. 3 is a view taken in the direction of line III—III of FIG. 2.
Figure 2:
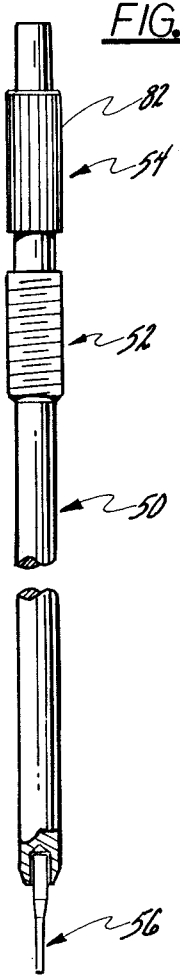
FIG. 2 is a cross-sectional view of the single molded piece which forms the body of the iron according to the invention.
Figure 1:
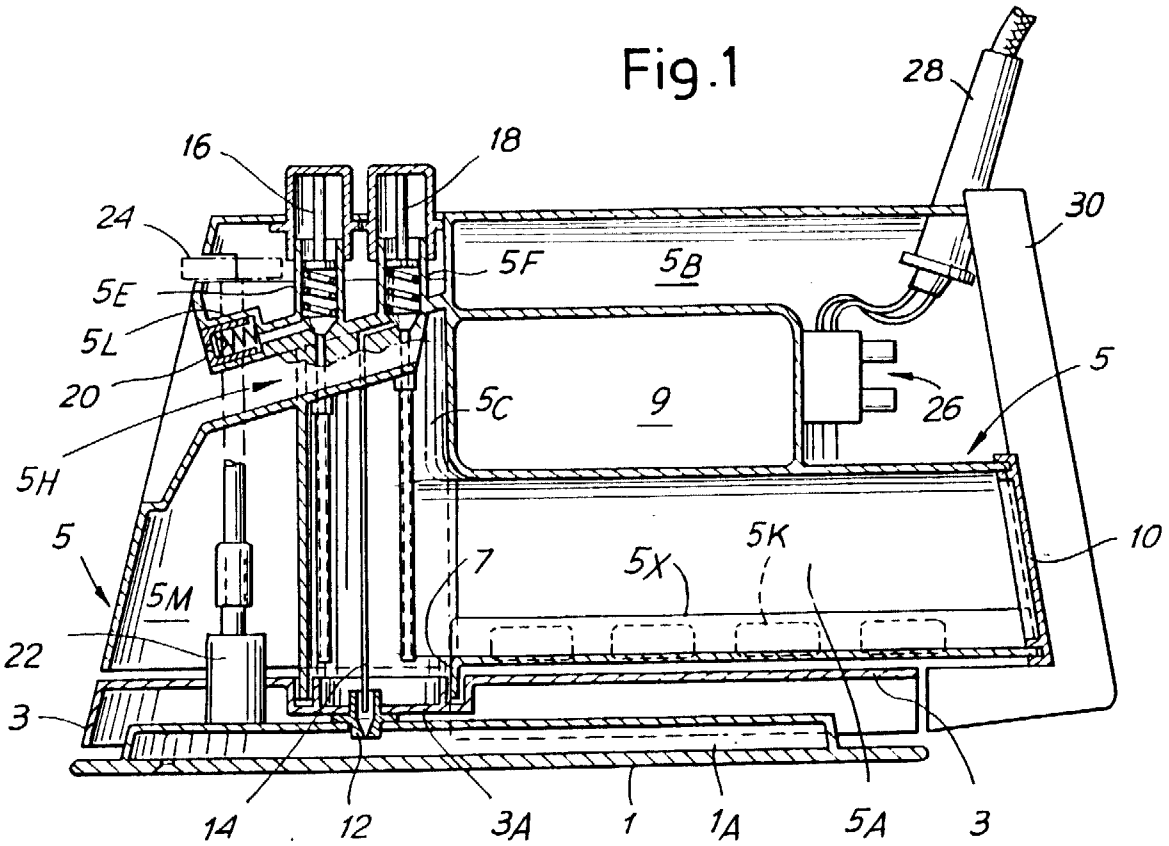
Figure 5:
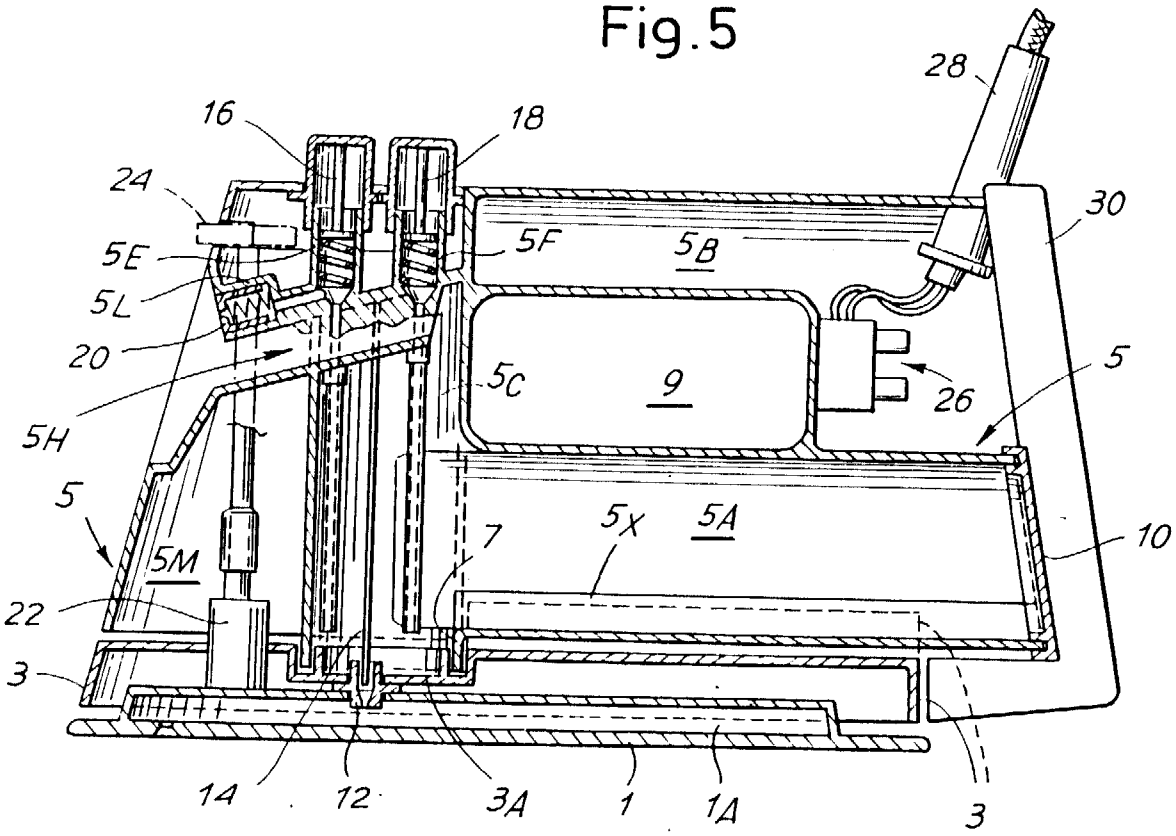

Fig.3
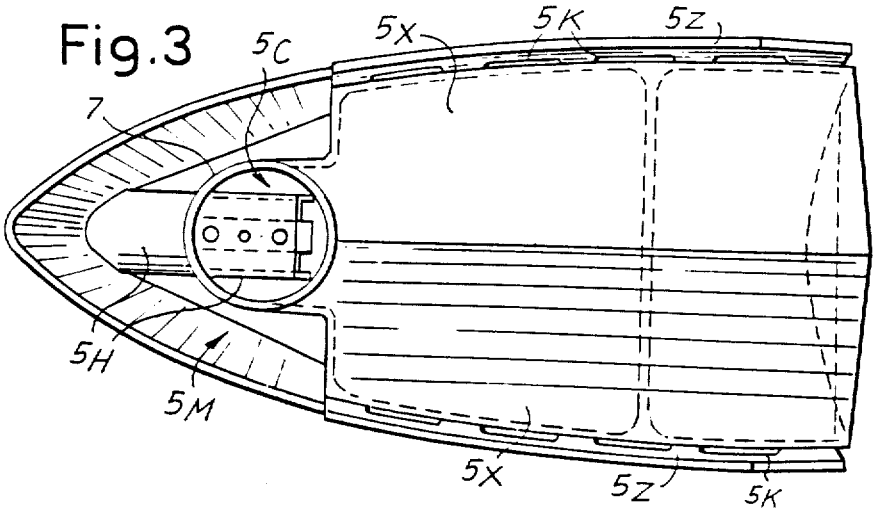
Fig. 2
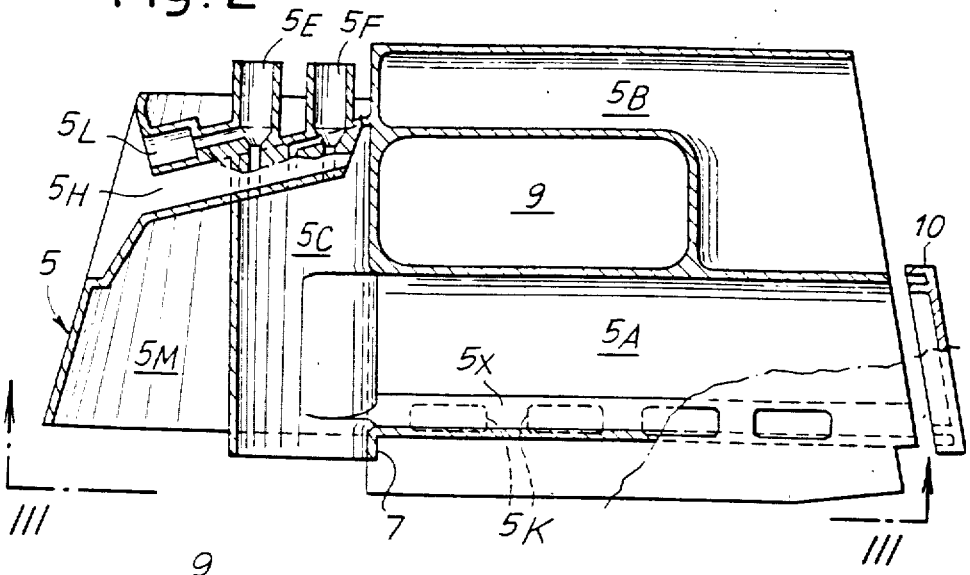
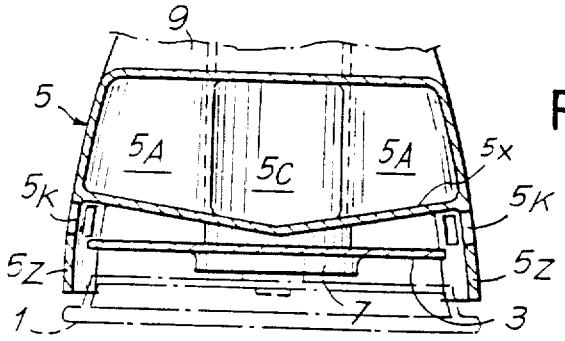
Fig.4